US006130586A

United States Patent [19]

Schulz

[11] Patent Number: 6,130,586

[45] Date of Patent: Oct. 10, 2000

[54] MODE FILTER FOR CONNECTING TWO ELECTROMAGNETIC WAVEGUIDES

[75] Inventor: Dietmar Schulz, Wedemark, Germany

[73] Assignee: Alcatel, Paris, France

[21] Appl. No.: 09/137,948

[22] Filed: Aug. 21, 1998

[30] Foreign Application Priority Data

Sep. 10, 1997 [DE] Germany ..... 197 39 589

[51] Int. Cl.[7] ..... H01P 1/162

[52] U.S. Cl. ..... 333/21 R; 333/251

[58] Field of Search ..... 333/21 R, 157, 333/251, 254

[56] References Cited

U.S. PATENT DOCUMENTS

| | | | |
|---|---|---|---|
| 4,100,514 | 7/1978 | DiTullio et al. | 333/21 R X |
| 4,344,053 | 8/1982 | Anderson . | |
| 4,540,959 | 9/1985 | Saad | 333/21 R |
| 4,553,112 | 11/1985 | Saad et al. . | |

FOREIGN PATENT DOCUMENTS

| | | |
|---|---|---|
| 03 09 850 A2 | 4/1989 | European Pat. Off. . |
| 12 71 229 | 6/1968 | Germany . |
| 60-125001 | 7/1985 | Japan . |

OTHER PUBLICATIONS

JP Patent Abstracts of Japan, 3–46801 A., E–1067, May 14, 1991, vol. 15, No. 187.

JP Patent Abstracts of Japan, 3–250801 A., E–1163, Feb. 6, 1992, Vo. 16, No. 48.

*Primary Examiner*—Paul Gensler

*Attorney, Agent, or Firm*—Ware, Fressola, Van Der Sluys & Adolphson LLP

[57] ABSTRACT

A mode filter for connecting two electromagnetic waveguides with different cross-sections includes a tubular section (4) with openings at both ends. The cross-sections of the openings match the cross-sections of the two different waveguides, while the interior space (11) of the tubular section (4) transitions from one cross-sectional shape into the other cross-sectional shape. Undesirable modes of the electromagnetic waves which are to be transmitted, are minimized by flat elements (14, 15) protruding radially inwardly into the transition region and extending axially along the tubular section (4). The flat elements (14, 15) are made of a material with a high electrical conductivity. The elements (14, 15) are arranged diametrically opposed from each other and aligned in the same plane and separated by a gap (16). The axial length of the flat elements is short in relation to the length of the tubular section (4). The length of the flat elements in the axial direction and the spacing (A) between them is dimensioned so as to minimize the ripple in the group velocity and the amplitude of the wave to be transmitted. The ripple is caused by the superposition of the excited modes.

6 Claims, 2 Drawing Sheets

MODE FILTER FOR CONNECTING TWO ELECTROMAGNETIC WAVEGUIDES

BACKGROUND OF THE INVENTION

1. Technical Field

The invention relates to a mode filter for connecting two electromagnetic waveguides with different cross-sectional shapes, which has a tubular section with openings at both ends. The cross-sections of the openings correspond to the respective cross-sections of the two different waveguides. The interior space of the tubular section changes over smoothly from one cross-sectional shape to the other. In the interior space of the tubular section, there are also arranged means for minimizing unwanted modes of the modes of propagation to be transmitted.

2. Description of the Prior Art

Waveguides exhibit low damping of transmitted electromagnetic waves, in particular at higher frequencies, and are used, for example, as feed lines for antennae. However, the damping can still be too high, for example, if the transmitted power is low or if large enough reflectors cannot be utilized. The waveguides can then be used overmoded, i.e. operated at higher frequencies than the design frequency. In this case, however, undesirable higher modes are then excited in the waveguides in addition to the desired fundamental mode. This causes ripples in the group velocity and in the amplitude of the fundamental mode, i.e. a variation of the amplitude of the fundamental mode. This effect cannot be completely eliminated; it can, however, be minimized by employing mode filters.

A mode filter of the type described above is distributed by the company RFS kabelmetal, Hannover, Germany. Such a mode filter decouples the undesirable modes. For this purpose, baffles are arranged on the wall of the mode filter which is in the form of a tubular section. The baffles are connected to absorbers attached on the outside of the tubular section. The absorbers are cooled during operation.

SUMMARY OF THE INVENTION

It is the object of the invention to simplify the construction of the mode filter of the type described above.

According to a feature of the invention, two flat elements made of a material with a high electrical conductivity are arranged in the interior space of the tubular section in the transition region between the two cross-sectional shapes. The diametrically opposed flat elements extend along the axis of the tubular section and protrude radially inwardly from the wall of the tubular section. They are aligned in the same plane and separated by a gap. Their length in the axial direction is short in relation to the length of the tubular section and is dimensioned, along with the spacing between the flat elements, so as to minimize the ripple in the group velocity and in the amplitude of the transmitted wave. The ripple is caused by superposition of the excited modes.

The construction of the mode filter is very simple, so that the mode filter can be manufactured with conventional techniques used to manufacture waveguide transitions. The two flat elements which are electrically conducting and which can be sections of sheet metal or rods, can be easily installed and adjusted through slots arranged in the tubular section. Surprisingly, the undesirable modes can be suppressed almost entirely by locating the flat elements appropriately. No absorbers are required and neither is cooling since no waste heat is generated. The mode filter are therefore also suitable for high power applications. The ripple in the group velocity and in the amplitude of the desired transmitted wave can thus be easily reduced to an acceptable minimum over a wide range of power.

The invention will be fully understood when reference is made to the following detailed description taken in conjunction with the accompanying drawings.

DETAILED DESCRIPTION OF THE INVENTION

The "flat elements" in the mode filter can be sheet metal sections. The sheet metal sections can be formed without cut-outs, but may also be formed as a comb with "teeth" projecting into the interior space of the mode filter. However, each element can be rods or strips arranged side-by-side. The elements are referred to as "flat" to denote a two-dimensional element. The elements have a uniform thickness and extend essentially in the radial direction. In the following, the terms "flat element" shall describe all possible embodiments.

Figure 1:
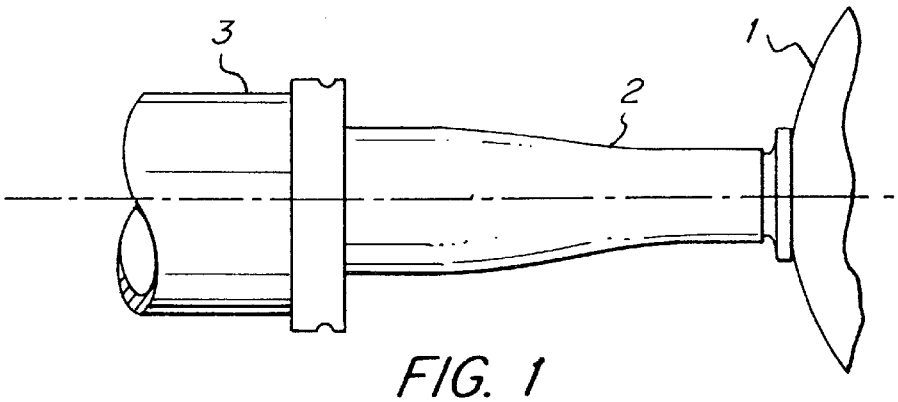
FIG. 1 is a side elevational view of an arrangement with a mode filter of the invention.
Figure 6:
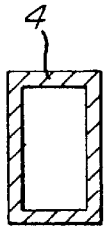
FIG. 6 is a sectional view taken along the line VI—VI of FIG. 4.

In FIG. 1, there is illustrated a parabolic reflector 1 of an antenna, with a mode filter 2 connecting the reflector 1 to an electromagnetic waveguide 3. The waveguide 3 and the waveguide input of the antenna can have arbitrary cross-sectional shapes. In the embodiment described hereinafter, the waveguide 3 of FIG. 1 has an elliptical cross-section, whereas the cross-section of the waveguide input of the antenna is rectangular, as shown in FIG. 6. Consequently, the mode filter 2 connects an elliptical waveguide to a rectangular waveguide input with clear opening dimensions which are significantly smaller than those of waveguide 3.

Figure 2:
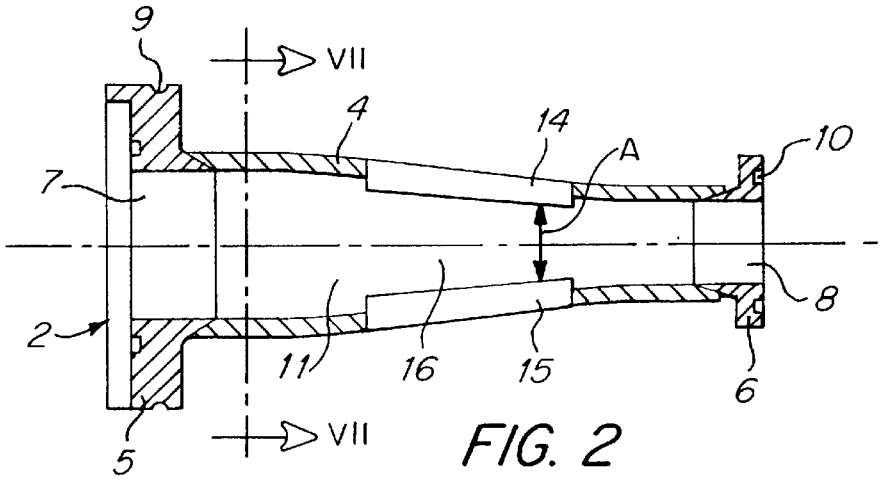
FIGS. 2 and 3 are enlarged longitudinal sectional views of the mode filter in two different planes.
Figure 3:
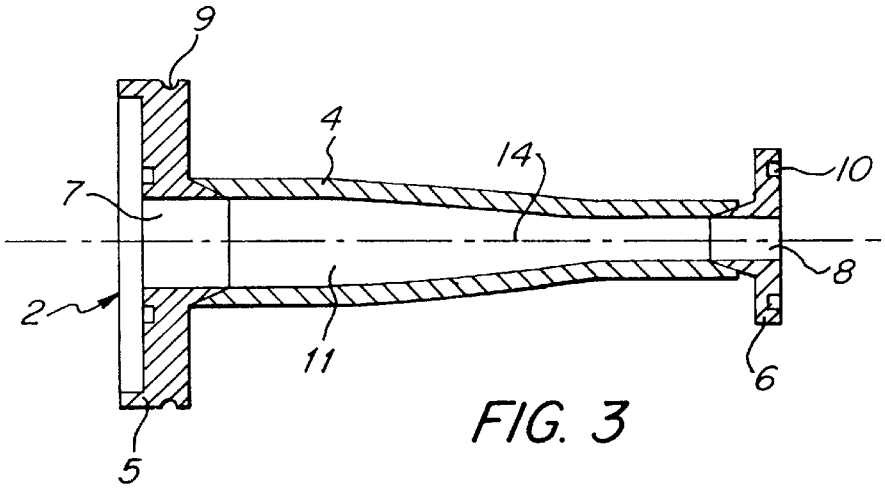

As seen in FIG. 2, the mode filter 2 is formed as a tubular section 4 with flanges 5 and 6 at both ends. The waveguide 3 is connected to flange 5 which has an inner continuous opening 7 with an elliptical cross-section which is the same as the effective electrical cross-section of the waveguide 3. On the other end of the tubular section 4, the flange 6 has an inner continuous opening 8 with a rectangular cross-section which has the same electrical effectiveness as the waveguide input of the antenna. The mode filter 2 can be attached to the reflector 1 via the flange 6. sealing elements can be arranged in the circumferential grooves 9 and 10 of the two flanges 5 and 6.

Figure 4:
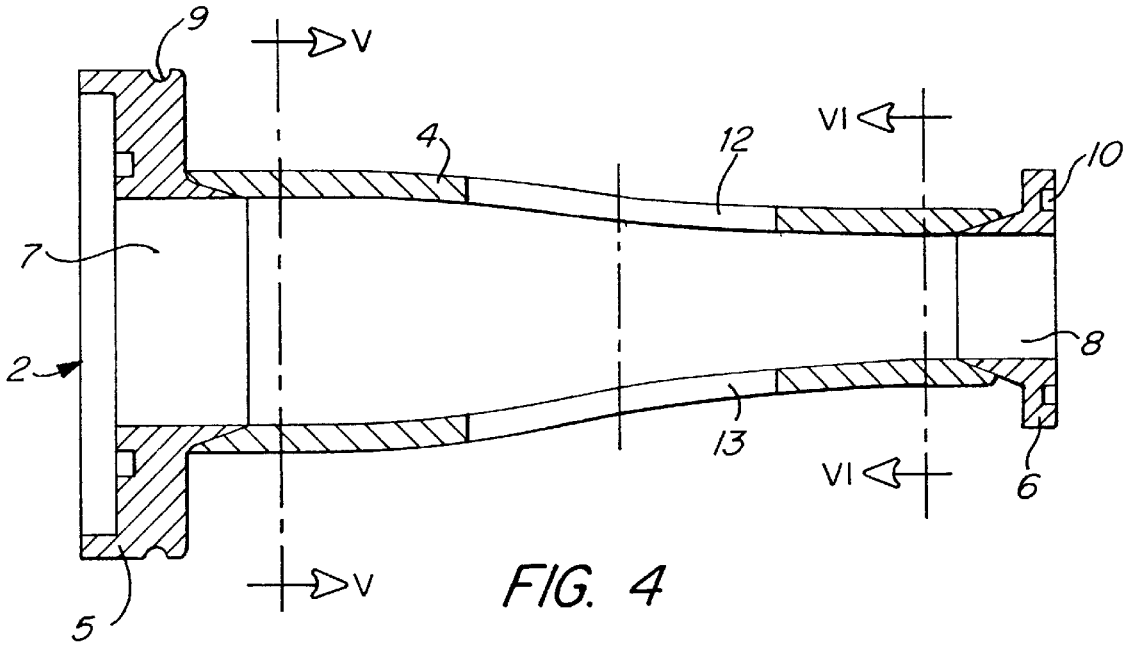
FIG. 4 is a view similar to FIG. 2 with the interior components removed.
Figure 5:
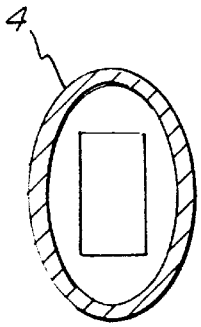
FIG. 5 is a sectional view taken along the line V—V of FIG. 4.

The flanges 5 and 6 can be manufactured with tight tolerances using conventional techniques. The tubular section 4 is preferably produced by electroplating on a mandrel whose outer contour corresponds exactly to the desired contour of the interior space 11 of the tubular section 4 and the mode filter 2, respectively. Simultaneously, the two flanges 5 and 6 are electroplated to the tubular section 4. The slots 12 and 13 (FIG. 4) which are formed at two diametrically opposed locations on the wall of the tubular section 4 and adapted to receive the sheet metal sections 14 and 15, can be manufactured together with the tubular section 4.

The interior space 11 of the tubular section 4 is shaped so as to form a continuous smooth transition from the elliptical cross-section of the waveguide 3 to the rectangular cross-section of the waveguide input of the antenna. It is in this transition region of the tubular section 11, that the sheet metal sections 14 and 15 are arranged. They project radially into the tubular section 4 and extend in the axial direction of the tubular section 4. Their axial length is small in relation to the length of the tubular section 4.

Figure 7:
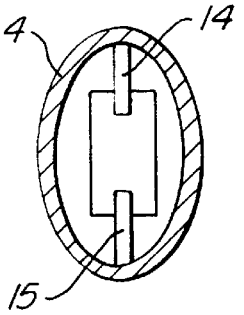
FIG. 7 is a sectional view taken along the line VII—VII of FIG. 2.

The sheet metal sections 14 and 15 are aligned with each other and are arranged diametrically opposed from each other in the same plane, as shown in FIG. 7. They are separated from each other by a gap 16 with a spacing in the embodiment which does not change along the entire axial length. The gap 16 can also be conical, as shown in FIG. 2. The conical shape is advantageous when rods are used instead of sheet metal. In the embodiment just described and illustrated, the waveguide 3 and the opening 7 of the flange 5 have an elliptical cross-section. The sheet metal sections 14 and 15 are preferably arranged along the major axis of the ellipse, as is shown in FIG. 7.

The distance A between the two sheet metal sections 14 and 15 and their axial length depend on the frequency of the fundamental wave guided in the waveguide 3. The distance A is adjusted to suppress higher modes as much as possible and thereby minimizing their influence on the fundamental wave. The amplitude of the "ripples" from the superposition of the different modes is then also minimized, allowing a precise control of the ripple of the fundamental wave.

The sheet metal sections 14 and 15 are made of a material with a high electrical conductivity, such as copper or aluminum. In a preferred embodiment, the sheet metal sections are made of bronze or brass. The sheet metal sections can, for example, be inserted in the slots 12 and 13 in the tubular section 4 after the tubular section 4, included the flanges 5 and 6, has been built. The position, i.e. the distance A between the sheet metal sections 14 and 15, is adjusted with a template inserted in the tubular section 4. The sheet metal sections 14 and 15 are then affixed in this position to the tubular section 4, e.g. by soldering. The portions of the sheet metal sections 14 and 15 protruding from the tubular section 4 are subsequently cut off, producing a smooth surface of the tubular section 4. The template for a specific type of mode filter has to be fabricated only once and can subsequently be used to produce a large number of mode filters.

In another embodiment of the manufacturing process, both the sheet metal sections 14 and 15 and the flanges 5 and 6 can be electroplated at the same time as the tubular section 4. As the template described above, the corresponding mandrel needs to be produced only once for a specific type of mode filter.

The embodiments described above admirably achieve the objects of the invention. However, it will be appreciated that departures can be made by those skilled in the art without departing from the spirit and scope of the invention which is limited only by the following claims.

What is claimed is:

1. Mode filter for connecting two electromagnetic waveguides with different first and second cross-sectional shapes, the electromagnetic waveguides for transmitting an electromagnetic wave having modes of propagation, the mode filter comprising:

(a) a tubular section having an axial length, a wall, and openings at both ends, the openings having first and second cross-sectional shapes corresponding to the first and second cross-sectional shapes of the two electromagnetic waveguides, the tubular section defining an interior space which forms a continuous smooth transition from the first cross-sectional shape of the tubular section into the second cross-sectional shape of the tubular section;

(b) two flat elements, for minimizing unwanted modes of propagation to be transmitted, are arranged in the interior space of the tubular section between the first and second cross-sectional shapes of the tubular section, the two flat elements being made of a material with a high electrical conductivity and projecting inwardly toward, and extending along an axis of, the tubular section and wherein the flat elements extend from the walls of the tubular section and are arranged opposing each other and in a common plane, the flat elements are aligned with respect to each other and are separated by a space, an axial length of the flat elements is short in relation to the axial length of the tubular section, and the axial length of the flat elements and the space between the flat elements are selected so as to minimize ripple in group velocity and in amplitude of the electromagnetic wave to be transmitted, wherein the ripple is caused by superposition of all excited modes.

2. Mode filter according to claim 1, wherein the flat elements are sheet metal sections.

3. Mode filter according to claim 1, wherein the flat elements are formed by rods.

4. Mode filter according to claim 1, wherein the first cross-sectional shape of the tubular section is elliptical in shape and has a major axis, and the plane in which the flat elements are arranged coincides with the major axis.

5. Mode filter according to claim 1, wherein the flat elements are made of bronze.

6. Mode filter according to claim 1, wherein the flat elements are made of brass.

* * * * *

UNITED STATES PATENT AND TRADEMARK OFFICE

CERTIFICATE OF CORRECTION

PATENT NO. : 6,130,586
DATED : October 10, 2000
INVENTOR(S) : Dietmar Schulz

It is certified that error appears in the above-identified patent and that said Letters Patent is hereby corrected as shown below:

Title page,
Under item [56] "References Cited, OTHER PUBLICATIONS", please add the following:

-- Huang et al., "Frequency-Domain TLM Analysis of the Transition from Rectangular to Circular Waveguides," in IEEE MTT-S International Microwave Symposium Digest, May 23, 1994, pp. 705-708, ISBN 0-7803-1779-3. --

Signed and Sealed this

Ninth Day of October, 2001

*Attest:*

Nicholas P. Godici

*Attesting Officer*

NICHOLAS P. GODICI
*Acting Director of the United States Patent and Trademark Office*